US007814955B2

(12) United States Patent
Harwood et al.

(10) Patent No.: US 7,814,955 B2
(45) Date of Patent: Oct. 19, 2010

(54) HYDROLYSIS RESISTANT WOVEN CORRUGATOR FABRIC

(75) Inventors: William J. Harwood, Waycross, GA (US); Gilbert Ross, Waycross, GA (US)

(73) Assignee: Voith Patent GmbH, Heidenheim (DE)

( * ) Notice: Subject to any disclaimer, the term of this patent is extended or adjusted under 35 U.S.C. 154(b) by 353 days.

(21) Appl. No.: 11/552,229

(22) Filed: Oct. 24, 2006

(65) Prior Publication Data

US 2008/0092979 A1 Apr. 24, 2008

(51) Int. Cl.

| | |
|---|---|
| ***D21F 7/12*** | (2006.01) |
| ***B32B 3/02*** | (2006.01) |
| ***B32B 5/08*** | (2006.01) |
| ***B31F 1/20*** | (2006.01) |

(52) U.S. Cl. ..... 156/462; 162/902; 139/383 A; 428/193; 428/223; 442/217; 442/302

(58) Field of Classification Search ..... 162/116, 162/348, 358.2, 900–904; 139/383 A, 425 A, 139/383 AA; 156/462; 428/192–194, 223; 442/217, 301, 302

See application file for complete search history.

(56) References Cited

U.S. PATENT DOCUMENTS

| | | | | |
|---|---|---|---|---|
| 4,403,632 | A * | 9/1983 | Romanski et al. | 139/383 A |
| 5,746,257 | A * | 5/1998 | Fry | 139/383 AA |
| 5,785,621 | A * | 7/1998 | Birzele | 474/267 |
| 5,875,822 | A * | 3/1999 | Fargeout | 139/383 AA |
| 5,938,007 | A * | 8/1999 | Fujihiro et al. | 198/847 |
| 6,302,155 | B1 * | 10/2001 | Rydin | 139/383 AA |
| 6,470,944 | B1 * | 10/2002 | Billings et al. | 156/462 |
| 7,105,465 | B2 * | 9/2006 | Patel et al. | 442/88 |
| 7,141,144 | B2 * | 11/2006 | Rydin | 162/358.2 |
| 7,273,074 | B2 * | 9/2007 | Hansen | 139/383 AA |
| 2007/0243360 | A1 | 10/2007 | Morton | |

* cited by examiner

*Primary Examiner*—Eric Hug
(74) *Attorney, Agent, or Firm*—Taylor IP, P.C.

(57) ABSTRACT

A woven corrugator belt having a fabric body that has a base layer fabricated from a polyester material and has at least 1 layer of the polyester that runs in both the machine direction and cross machine direction of the belt. The fabric body has a first end and a second end that are joined by use of an inline seam. A material having greater hydrolysis resistance than the polyester may be woven into side portions of the belt for improved hydrolysis resistance.

15 Claims, 3 Drawing Sheets

HYDROLYSIS RESISTANT WOVEN CORRUGATOR FABRIC

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The invention relates to belts used on corrugator box-board machines, and more particularly, to an in-line seamed woven belt whereby fabric edges are protected by the addition of polyphenylenesulfide (PPS) or polyetheretherketone (PEEK) yarns.

2. Background of the Invention

On a corrugator box-board machine there is a transformation from sheets of linerboard paper and corrugating medium paper into corrugated box-board. This is achieved by the application of a liquid adhesive to the three sheets of paper and the pressing by one or more corrugator belts, woven or needled or a combination thereof onto a series of steam-heated plates to dry the adhesive thereby "gluing" the paper assembly together. The heat from the plates is conducted directly to the "glued paper" (corrugated box-board) and through this into the corrugator belt.

As well as this drying function, the belt must pass the corrugated box-board through the cooling section and thereafter onto the next stage.

It is generally desirable that corrugator belts possess certain properties such as strength, durability, be dimensionally stable, and have a non-marking seam all under the conditions of high temperature and steam, plus high tension. Additionally, the belts should be flexible in the machine direction yet be sufficiently stable in the cross machine direction so as to maintain close to the belt's original dimensions and facilitate the ability to be guided along its passage around the machine under the conditions described. It is also desirable for the belts to be sufficiently permeable to allow the vapor to pass easily through the material so as not to rewet the corrugated box-board.

Previous corrugator belts had low permeability and utilized the principal of absorption and then evaporation, resulting in the rewetting of the corrugated box-board. This restricted the speed of the corrugator machine because drying was being restricted. These types of belts were typically heavy and very low permeability. The desirable properties had to be achieved by the utilization of a relatively thicker caliper belt composed of spun and multifilament material.

A non-woven type of belt, for example spiral fabrics have also been employed as corrugator belts, but by their nature have problems of mechanical edge damage, for example unravelling and then the unravelled portion being caught on an object within the machine, causing catastrophic failure. Additionally, board slippage resulted due to the slick surface, causing board quality issues and degradation of the fabric edges was caused by the constant exposure to steam, generally by hydrolysis.

The edges of the belt are exposed to more abrasion and heat and hydrolysis degradation as the width of the corrugated box-board changes, which is normal on a corrugator machine. Where there is no corrugated box-board protecting the belt, there is increased abrasion and heat and hydrolysis degradation.

Accordingly, a need exists for a corrugator belt having the ability to survive under the harsh environments longer, by postponing the wear and degradation at the exposed sides of the fabric.

SUMMARY OF THE INVENTION

A corrugator belt meeting the needs discussed above is an engineered woven product that is composed of different materials carefully selected for their desirable properties.

Accordingly, the invention is for a fabric, also known as a belt that is designed with predetermined permeability. The predetermined permeability may be based on the needs of the corrugator machine onto which it will be installed. The fabric is lighter, easier to install, uses less steam than conventional fabrics to dry the board and uses less energy to drive the belt than conventional belts. The edges and seam which are normally the weakest portions of the belt are protected with state-of-the-art materials.

The material used for the body of the composite fabric is at least one of polyester or polyethylenepterathalate (PET). The base structure of the belt is preferably fabricated using polyester monofilament of one or more layers. In the preferred embodiment there is a minimum of one layer and a maximum of ten layers. Alternatively, the base structure of the fabric can be 100% PPS or PEEK monofilament yarns.

The edge portions of the fabric, when not in contact or otherwise covered by the web, is exposed to the harsher environment of the corrugator machine running conditions. Along with the seam, these are the weakest portions of the fabric. It is preferable that additional edge material is added to the main portion of the fabric. That is, a main central portion of the fabric running in the machine direction has additional or more resistant material added to the side panel area. The box board generally covers the main middle portion, and overlays, or extends to cover a portion of the side portions.

The edges of the belt are preferably reinforced with polyphenylenesulfide (PPS) or polyetheretherketone (PEEK) monofilament yarns to give added strength and excellent heat and hydrolysis resistance. PPS offers the broadest resistance to chemicals of any advanced engineering plastic. PPS has no known solvents below 392° F. (200° C.) and is inert to steam, strong bases, fuels and acids. Minimal moisture absorption and a very low coefficient of linear thermal expansion, combined with stress-relieving manufacturing, make PPS ideally suited for corrugator belt applications. In the preferred embodiment, substantially pure PPS or PPS with additional alloys, such as nylon, is used.

The PPS or PEEK monofilament yarns can be woven so they lie preferably below the surface of the polyester. The surface of the polyester in the preferred embodiment is typically approximately 0.2 mm diameter to approximately 2.0 mm diameter, more preferably approximately 0.60 mm diameter and the PPS or PEEK monofilament yarns are approximately 0.6-0.7 mm, preferably approximately 0.67 mm wide by approximately 0.2-0.5 mm, preferably approximately 0.36 mm high rectangular shaped so they are protected from wear. The PPS or PEEK monofilament yarns can also be woven on the surface of the polyester fabric to form a knuckle next to a polyester knuckle. Alternatively, the PPS or the PEEK monofilament yarns are approximately the same diameter as the polyester and lie in the same plane.

In the fabric, the first side portion is woven with PPS or PEEK to the fabric body along one side edge. The second side portion is also woven with PPS or PEEK to the fabric body along a second side edge. The second side edge is opposite the first side edge.

Likewise, the first and second side portions can have the same weave pattern as the fabric body.

When a spiral pin seam is used to join the ends of the fabric, the seam is preferably composed of a PEEK material, having very high heat and hydrolysis resistance. Likewise, the caliper is approximately the same as the fabric and in-line with the body of the fabric so no or minimal seam marking can occur. The spiral used in the seam may be composed of PEEK, PPS or PET monofilament yarns. The result is less waste as less board product is rejected due to seam marks that result in printing and other blemishes.

A loop seam may also be utilized to join the ends of the fabric. The seam loops are preferably formed from the machine direction yarns to engineer a preferably completely in-line, preferably a non-marking seam for all grades of boxboard. The result is less waste as less board product is rejected due to seam marks that result in printing and other blemishes.

Both the spiral pin seam and the loop seam are preferably in-line with the plane of the fabric.

Permeability of the belt is preferably in the range of approximately 50-2,000 cfm, more preferably in the range of 100-1500 cfm. The resulting belt is therefore stable, yet flexible. It has a knuckled, woven surface with a necessary coefficient of friction to drive the board through the machine. The belt is also sufficiently permeable to allow vapour to pass through the fabric to allow faster machine speeds and improved drying rates.

The fabric as constructed is stable yet flexible, and has a knuckled or floated, woven surface for the necessary coefficient of friction to drive the board through the machine. The fabric is sufficiently permeable to allow the vapor to pass through the fabric to allow faster machine speeds and improved drying rates.

Alternatively, the fabric can be manufactured without PPS or PEEK. In the present invention, a different edge material is added to the main portion of the fabric. That is, a main central portion of the fabric running in the machine direction has additional or replacement yarns added to the side panel area. The box board generally covers the main middle portion, and overlays, or extends to cover a portion of the side portions.

Still further, the first and second side portions can be subjected to the same processing as the fabric body, for example, heat setting, stretching, coating, and the like. When a coating is utilized, the coating, when compared to the composite fabric, has at least one of enhanced release properties, enhanced wear properties and enhanced thermal stability.

The material used for the first side portion is at least one of polyphenylenesulfide (PPS), polyetheretherketone (PEEK), high temperature and hydrolysis resistant polymers, blends using PPS, blends using PEEK, alloys of PPS, alloys of PEEK, nylon, carbon impregnated nylon, or other conductive materials.

It is also preferred that the fabric body and the first side portion have substantially the same CFM throughput. However, depending on the design parameters, the CFM throughput of the first side portion can be different from the fabric body, or may be different from the second side portion.

Additionally, it is preferred that there is a smooth transition between the main portion of the fabric and the side portions.

The size of the first and second side portions is dependent upon the size of the paper web. The width of the side portions may be 1 inch to all the way across the fabric or belt when measured in the weft direction. Preferably the width of the side portions is approximately 10 inches to approximately 30 inches, and more preferably approximately 24 inches when measured in the weft direction.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

Figure 1:
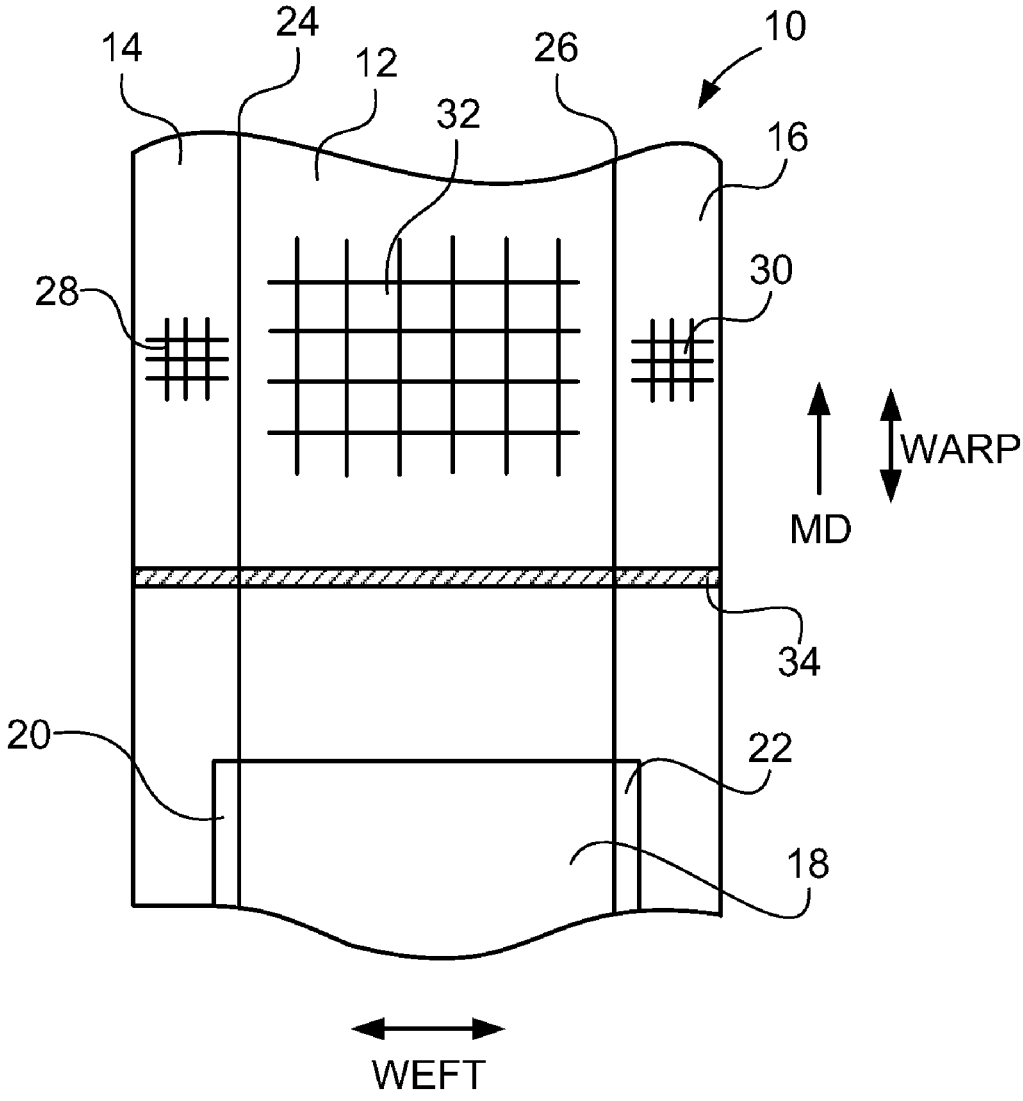
FIG. 1 is a plan view of the woven fabric of the present invention.
Figure 2:
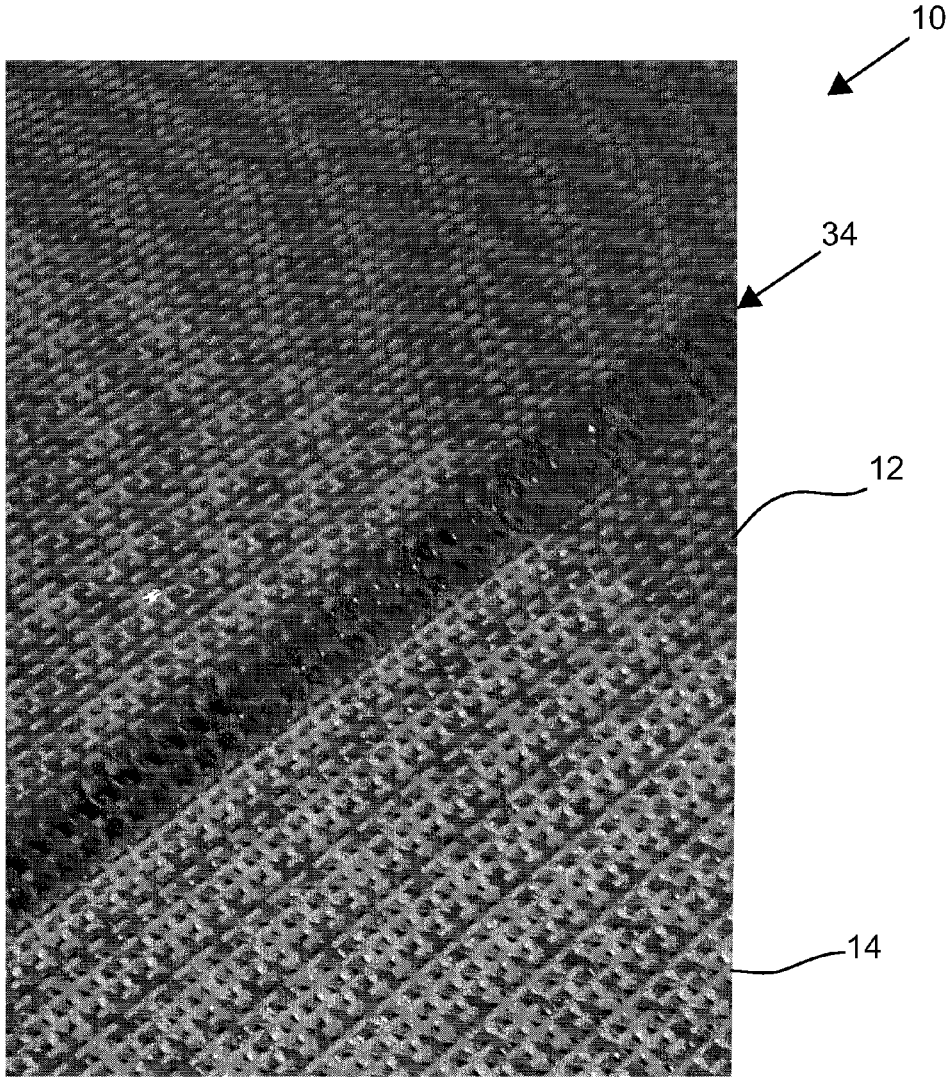
FIG. 2 is a plan view of the seam area of the woven fabric of the present invention depicting a spiral seam.
Figure 3:
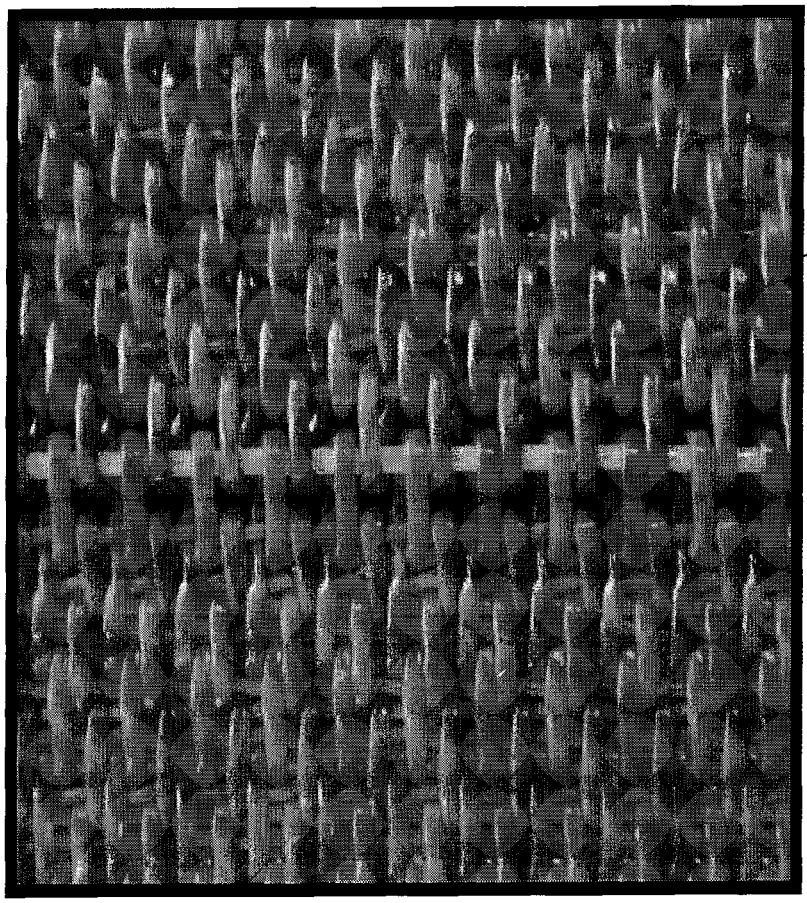
FIG. 3 is a plan view of the seam area of the woven fabric of the present invention depicting a loop seam.

FIG. 1 depicts a schematic plan view of the fabric 10 of the present invention. FIG. 2 is a plan view of the seam area of the woven fabric of the present invention depicting a spiral seam. FIG. 3 is a plan view of the seam area of the woven fabric of the present invention depicting a loop seam. The composite fabric has a central fabric portion 12, a first fabric side portion 14, and a second fabric side portion. MD indicates the machine direction of the composite fabric.

It is understood that the first fabric side portion 14 and the second fabric side portion 16 are interchangeable, and reference to one may be interchanged with the other. Additionally, the plan view of FIG. 1 may represent either the board side or the back side.

The central portion 12 can be any woven fabric known in the art. The material used for the central portion 12 is preferably fabricated using polyester monofilament of one layer or more than one layer, preferably 1-10 layers, and more preferably 1-3 layers.

The first fabric side portion 14 is a reinforced edge of the fabric 10. That is, the central fabric portion of the fabric running in the machine direction has side panels 14, 16. Side panels 14, 16 are reinforced with PPS or PEEK. The box board 18 generally covers the central fabric portion 12, and overlays, or extends to cover a portion of the side portions 14, 16 at first and second paper web overlays 20, 22.

In the fabric 10, the first side portion 14 is part of the central fabric portion 12 along a first demarcation line 24. The second fabric side portion 16 is part of the central fabric portion 12 along a second demarcation line 26. The second demarcation line 26 is opposite the first demarcation line 24. The first and second fabric side portions 14, 16 can be part of the central fabric portion 12, or woven to the central fabric portion 12. Weaving of the first and second fabric side portions 14, 16 to the central fabric body 12 is preferably performed on the same loom on which the central fabric body was woven.

There is no requirement that the first fabric side portion 14 have the same weave pattern as the central fabric portion 12 or the second fabric side portion 16. In the preferred embodiment, the first and second fabric portions 14, 16 have the same weave pattern, and at least one of the materials making up the central fabric portion 12 is part of the weave of the first and second fabric side portions 14, 16. Additionally, it is preferable that the first and second fabric portions 14, 16 have the same weave pattern as the central fabric portion 12.

Still further, the first and second fabric side portions 14, 16 can be subjected to the same processing as the central fabric portion 12. For example, heat setting, stretching, coating, and the like.

The material used for the central fabric portion 12 of the composite fabric 10 is preferably polyester, but may be PPS or PEEK.

The material used for the first fabric side portion 14 and/or the second fabric side portion 16 is preferably at least one of polyphenylenesulfide (PPS) and polyetheretherketone (PEEK), high temperature and hydrolysis resistant polymers, blends using PPS, blends using PEEK, alloys of PPS, alloys of PEEK, nylon, carbon impregnated nylon, or other conductive materials.

In the preferred embodiment, the side edges 14, 16 of the belt are woven with the same yarns as the base fabric of the central fabric portion 12, and the side edges are reinforced with polyphenylenesulfide (PPS) or polyetheretherketone (PEEK) to give added strength and excellent heat and hydrolysis resistance. PPS offers the broadest resistance to chemicals of any advanced engineering plastic. PPS has no known solvents below 392° F. (200° C.) and is inert to steam, strong bases, fuels and acids. Minimal moisture absorption and a very low coefficient of linear thermal expansion, combined with stress-relieving manufacturing, make PPS ideally suited for corrugator belt applications. In the preferred embodiment, substantially pure PPS or PPS with additional alloys, such as nylon, is used.

Additionally, the diameter of first fabric side portion fibers 28 used for the first fabric side portion 14, and the diameter of second fabric side portion fibers 30 used for the second fabric side portion 16 can be substantially the same as the diameter of the central fabric portion fibers 32 used for the central fabric portion 12.

When the first side portion is woven to the fabric body, it is preferably woven in the same plane.

The PPS or PEEK can be woven into the side edges 14, 16 so it lies preferably below the surface of the polyester. The surface of the polyester in the preferred embodiment is typically approximately 0.2 mm diameter to approximately 2.0 mm diameter, more preferably approximately 0.60 mm diameter and the PPS or PEEK is approximately 0.6-0.7 mm, preferably approximately 0.67 mm wide by approximately 0.2-0.5 mm, preferably approximately 0.36 mm high rectangular shaped so it is protected from wear. The PPS or PEEK can also be woven on the surface of the polyester fabric to form a knuckle nest to a polyester knuckle. Alternatively, the PPS or the PEEK is approximately the same diameter as the polyester and lies in the same plane.

When a spiral-pin seam 34 shown in FIG. 2 is used to join the ends of the fabric 10, the seam 34 is preferably composed of a PEEK material, having very high heat and hydrolysis resistance. Likewise, the caliper is approximately the same as the fabric so no seam marking can occur. The spiral used in the seam may be composed of PEEK, PPS or PET yarns. A loop seam 36 as shown in FIG. 3 may also be utilized. The seam loops 38 are preferably formed from the machine direction yarns or the spiral loops 34 that are attached to the machine direction yarns to engineer a preferably completely in-line non-marking seam for all grades of box-board. The result is less waste as less board product is rejected due to seam marks that result in printing and other blemishes.

Both the spiral seam 34 and the loop seam 36 are preferably in-line with the plane of the fabric 10.

Permeability of the belt 10 is preferably in the range of approximately 50-2,000 cfm, more preferably in the range of 100-1500 cfm. The belt is therefore stable, yet flexible. It has a knuckled, woven surface for the necessary coefficient of friction to drive the board through the machine. The belt is also sufficiently permeable to allow the vapor to pass through the fabric to allow faster machine speeds and improved drying rates.

The edge portions of the fabric, when not in contact or otherwise covered by the web, is exposed to the harsher environment of the paper machine running conditions. Along with the seam, these are the weakest portions of the fabric. It is preferable that additional edge material is added to the main portion of the fabric. That is, a main central portion of the fabric running in the machine direction has additional or different materials added to the side panel area. The box board generally covers the main middle portion, and overlays, or extends to cover a portion of the side portions.

The fabric 10 as constructed is stable yet flexible, and has a knuckled or floated, woven surface for the necessary coefficient of friction to drive the board through the machine. The fabric is sufficiently permeable to allow the vapor to pass through the fabric to allow faster machine speeds and improved drying rates.

Alternatively, the fabric 10 can be manufactured without PPS or PEEK. In the present invention, a different edge material is added to the main portion of the fabric. That is, a main central portion of the fabric running in the machine direction has additional or replacement yarns in the side panel area. The box board generally covers the main middle portion, and overlays, or extends to cover a portion of the side portions.

Additionally, it is preferred that there is a smooth transition between the main portion of the fabric and the side portions.

The size of the first and second side portions is dependent upon the swidth of the box board. The width of the side portions may be 1 inch to all the way across the fabric or belt when measured in the weft direction. Preferably the width of the side portions is approximately 10 inches to approximately 30 inches, and more preferably approximately 24 inches when measured in the weft direction.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present extends to all functionally equivalent structures, methods and uses, such as are within the scope of the appended claims.

What is claimed as new and desired to be protected by Letters Patent of the United States is:

1. A woven corrugator belt comprising:

a fabric body having a base layer fabricated from a first material and having at least 1 layer of the first material that runs in both the machine direction and cross machine direction, the fabric body having a first end, a second end, a first side portion, a second side portion, and a second material woven with the first material in at least one of the first side portion and the second side portion; and an inline seam that joins the first fabric end to the second fabric end;

wherein the first material is a polyester and the second material is polyetheretherketone (PEEK).

2. The belt of claim 1, wherein the polyester is a polyester monofilament.

3. The belt of claim 1, wherein the first side portion has the same processing as the fabric body.

4. The belt of claim 1, wherein the second material has a hydrolysis resistance greater than the first material.

5. The belt of claim 1, wherein a width of the first side portion across the belt in the cross machine direction is approximately 1 inch to approximately all the way across the belt.

6. The belt of claim 5, wherein the width of the first side portion is approximately 10 inches to approximately 30 inches.

7. The belt of claim 1, wherein the belt has a permeability in the range of approximately 50-2,000 cfm.

8. The belt of claim 1, wherein the inline seam is a loop seam formed by the first material running in the machine direction, the loop seam including PEEK.

9. A woven corrugator belt comprising:

a fabric body having a base layer fabricated from a first material having at least 1 layer of the first material that runs in both the machine direction and cross machine direction, the fabric body having a first end, a second end, a first side portion, a second side portion, and a second material woven with the first material in at least one of the first side portion and the second side portion; and an inline seam that joins the first fabric end to the second fabric end;

wherein the first material is a polyester and the second material is polyetheretherketone (PEEK);

wherein the inline seam is a spiral seam attached to the first material running in the machine direction, the spiral seam including the second material.

10. The belt of claim 9, wherein the polyester is a polyester mono filament.

11. The belt of claim 9, wherein the first side portion has the same processing as the fabric body.

12. The belt of claim 9, wherein the second material has a hydrolysis resistance greater than the first material.

13. The belt of claim 9, wherein a width of the first side portion across the belt in the cross machine direction is approximately 1 inch to approximately all the way across the belt.

14. The belt of claim 13, wherein the width of the first side portion is approximately 10 inches to approximately 30 inches.

15. The belt of claim 9, wherein the belt has a permeability in the range of approximately 50-2,000 cfm.

* * * * *